US005358137A

United States Patent [19]

Shuert et al.

[11] Patent Number: 5,358,137

[45] Date of Patent: Oct. 25, 1994

[54] LIQUID BULK CONTAINER WITH TENSIONING STRAPS

[75] Inventors: Lyle H. Shuert, Bloomfield Hills, Mich.; Claude Decroix, Saverne, France

[73] Assignee: Sotralentz, S.A., Drulingen, France

[21] Appl. No.: 180,539

[22] Filed: Jan. 12, 1994

Related U.S. Application Data

[63] Continuation of Ser. No. 974,557, Nov. 12, 1992, abandoned.

[51] Int. Cl.[5] ..... B65D 19/10

[52] U.S. Cl. ..... 220/401; 220/410; 220/403; 220/495; 220/625; 206/600

[58] Field of Search ..... 108/55.5, 55.3, 55.1; 206/600, 386; 220/4.12, 4.16, 1.5, 403, 404, 408, 410, 401, 495, 494, 625

[56] References Cited

U.S. PATENT DOCUMENTS

| | | | |
|---|---|---|---|
| 2,893,588 | 7/1959 | Martin | 220/4 |
| 3,664,570 | 5/1972 | Kupersmit | 229/23 |
| 3,797,691 | 3/1974 | Williams | 220/1.5 |
| 4,119,263 | 10/1978 | Cuthbertson et al. | 220/403 |
| 4,165,024 | 8/1979 | Oswalt et al. | 206/386 |
| 4,550,830 | 11/1985 | Shuert | 206/386 |
| 4,676,373 | 6/1987 | Schneider | 206/386 |
| 4,765,252 | 8/1988 | Shuert | 108/55.1 |
| 4,856,657 | 8/1989 | Shuert | 206/600 |
| 4,936,451 | 6/1990 | Shuert | 206/386 |
| 4,989,731 | 2/1991 | Shuert | 206/386 |
| 5,029,734 | 7/1991 | Nichols | 108/55.3 |
| 5,109,985 | 5/1992 | Rose | 206/600 |
| 5,110,000 | 5/1992 | Nichols | 220/403 |
| 5,111,937 | 5/1992 | Schutz | 206/386 |
| 5,133,460 | 7/1992 | Shuert | 206/600 |

FOREIGN PATENT DOCUMENTS 9118806 12/1991 PCT Int'l Appl. ..... 206/386

OTHER PUBLICATIONS

Sotralentz SL5 Standard Brochure, Oct. 1991.

*Primary Examiner*—S. Castellano

*Attorney, Agent, or Firm*—Krass & Young

[57] ABSTRACT

A bulk liquid container including a pallet defining an annular outer peripheral portion defining an upwardly facing annular seat and a central platform portion within the outer peripheral portion; an annular cage including an annular sidewall structure and an annular lower edge positioned on the annular seat; and a bulk liquid bottle positioned in the sleeve with its sidewall structure juxtaposed to the sleeve sidewall structure and its bottom positioned on the platform portion. The pallet defines an upstanding rim extending around the annular seat and a plurality of circumferentially spaced channels opening inwardly of the annular seat and above the seat. A plurality of straps extend through openings in the rim and through an opening in the lower annular portion of the cage for passage into a respective channel. The inner end of each strap is anchored to the platform of the pallet by the downward force of the liquid in the bottle and by an interlocking structure engaging the inner end of the strap, and the outer end of the strap includes an enlarged head positioned against the outer surface of the rim. Outward force exerted by the liquid in the bottle against the sidewall of the sleeve is transferred to an outward force on the rim of the pallet, and the outward force on the rim of the pallet is in turn converted by the straps into outward pulling forces on the platform portion of the pallet so that the straps, in combination, tension the platform portion in the manner of a drum.

7 Claims, 5 Drawing Sheets

LIQUID BULK CONTAINER WITH TENSIONING STRAPS

This is a continuation of patent application Ser. No. 07/974,557 filed on Nov. 12, 1992 now abandoned.

BACKGROUND OF THE INVENTION

This invention relates to bulk containers and more particularly to a container of the type including a pallet, a sleeve supported on the pallet, and a bulk receptacle positioned within the sleeve and resting on the pallet.

Bulk containers are in common usage and typically include a bottle, formed for example of blow molded polyethylene; a protective sleeve or cage, formed for example of stretched steel wires assembled by welding; and a pallet on which the cage and bottle are supported. The pallet may be formed of wood, plastic or metal. Whereas these bulk containers are in common usage and have been generally satisfactory, there are disadvantages associated with each of the several types of pallets utilized to support the cage and bottle. For example, the wooden pallets are heavy, easily damaged, and require large amounts of storage space. The metal pallets are heavy and quite expensive. The plastic pallets are either unable to handle the extremely heavy loading generated by the liquids in the bottle or, if reinforced to an extent where they can handle the loading, are extremely heavy and expensive.

SUMMARY OF THE INVENTION

This invention is directed to the provision of an improved bulk container.

This invention is further directed to the provision of an improved pallet for use with a bulk container.

The invention relates to a container of the type including a pallet defining an annular outer peripheral portion and a central platform portion within the outer peripheral portion and a sleeve including an annular sidewall structure and an annular lower edge portion positioned on the pallet so that bulk fluid material positioned with the sleeve exerts a force outwardly against the sleeve sidewall structure.

According to the invention, the container includes means operative to transfer the outward force on the sleeve generated by the bulk fluid material within the sleeve into a outward force on the annular outer peripheral portion of the pallet so as to tension the pallet platform portion in the manner of a drum. This arrangement allows a relatively lightweight pallet, formed for example of plastic material, to satisfactorily handle the extremely heavy loading generated by the bulk fluid material within the sleeve.

According to a further feature of the invention, the peripheral portion of the pallet defines an upwardly facing annular seat, the annular lower edge portion of the sleeve is positioned on the seat, and the transfer means includes an annular upstanding rim extending around the annular seat in surrounding relation to the annular lower edge portion of the sleeve, so that the outward force on the sleeve is transferred to an outward force on the rim, and means for converting the outward force on the rim into a force tensioning the platform portion.

According to a further feature of the invention, the means for converting the outward force on the rim into a force tensioning the platform portion comprises a plurality of circumferentially spaced outwardly extending strap members each having its inner end anchored to the pallet platform portion, passing through an opening in the annular lower edge portion of the sleeve and through an opening in the rim, and including a head portion positioned radially outwardly of the rim. With this arrangement, the bulk fluid material within the sleeve anchors the inner end of the strap members and the strap members act through their head portions to pull outwardly and tension the platform portion in response to the outward force on the rim exerted by the bulk fluid material within the sleeve acting through the sleeve.

According to a further feature of the invention, the pallet is a twin sheet plastic structure including upper and lower plastic sheets selectively spaced apart to define a plurality of circumferentially spaced inwardly extending channels for respective receipt of the strap members. The use of a twin sheet plastic construction maximizes the strength and rigidity of the pallet and facilitates the provision of channel members to receive and locate the respective strap members.

According to a further feature of the invention, the inner end of each strap member includes a hole and one of the sheets of the pallet defines a protuberance proximate the inner end of each channel for interlocking positioning within the hole in the inner end of the respective strap member to augment the anchoring of the strap member to the platform portion of the pallet.

According to a further feature of the invention, the container further includes a bulk receptacle positioned within the sleeve and including a side wall structure juxtaposed to the side wall structure of the sleeve so that bulk fluid material positioned within the receptacle exerts an outward force on the sleeve via the receptacle.

In the disclosed embodiment of the invention, the bulk receptacle comprises a bulk liquid bottle so that bulk liquid in the bottle exerts an outward force on the sleeve via the bottle.

The invention further provides an improved pallet comprising an annular outer peripheral portion defining an upwardly facing annular seat; a central platform portion within the annular seat; an upstanding rim on the annular portion extending around the annular seat and including a plurality of circumferentially spaced openings; a plurality of circumferentially spaced inwardly extending channels in the platform portion respectively and circumferentially aligned with the rim openings and positioned proximate the annular outer portion of the pallet inwardly of and above the annular seat; and a plurality of strap members extending through a respective opening in the rim and into a respective channel in overlying relation to the seat.

DETAILED DESCRIPTION OF THE PREFERRED EMBODIMENT

Figure 1:
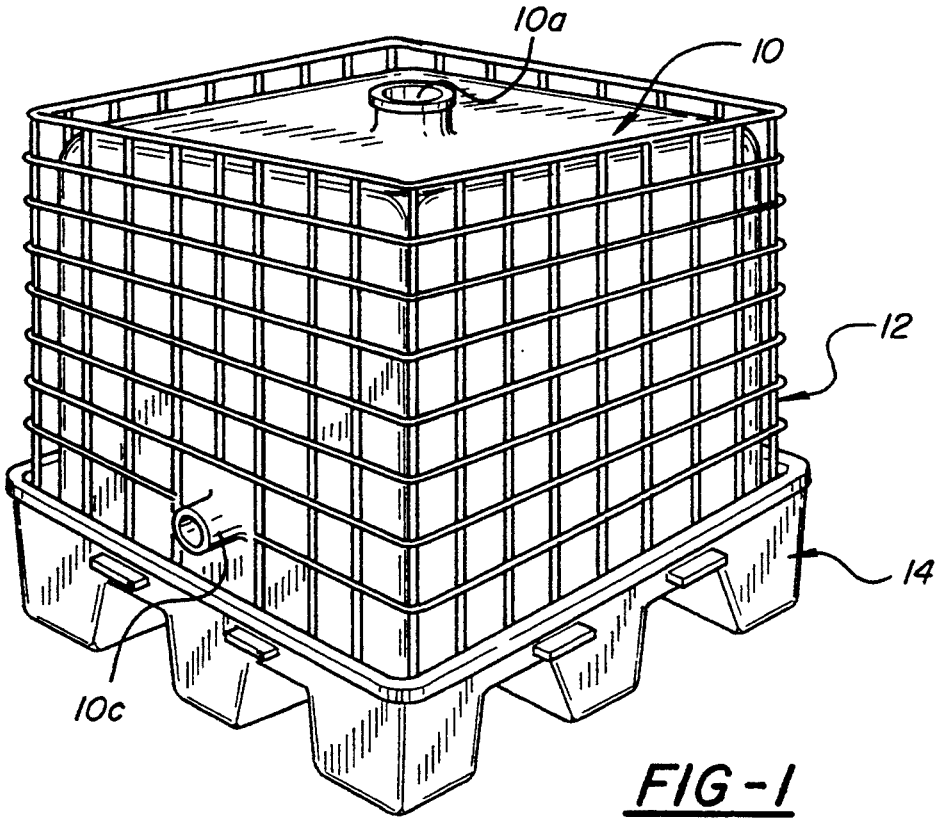
FIG. 1 is a perspective view of a bulk container according to the invention.
Figure 6:
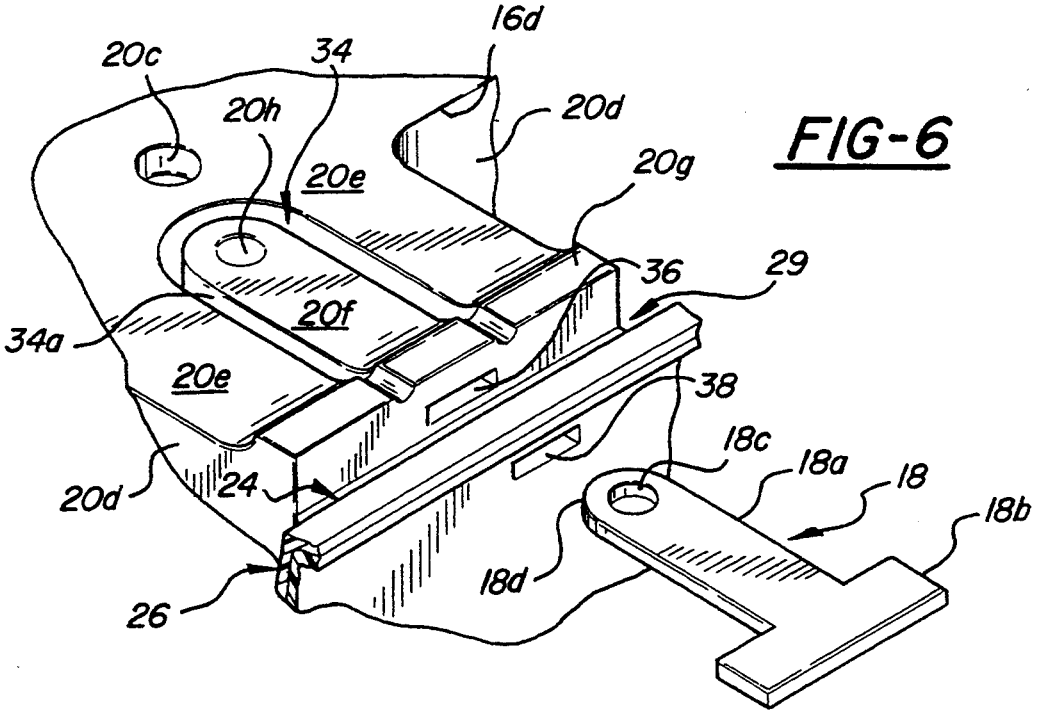
FIG. 6 is a fragmentary detail view of the pallet of the invention container.
Figure 2:
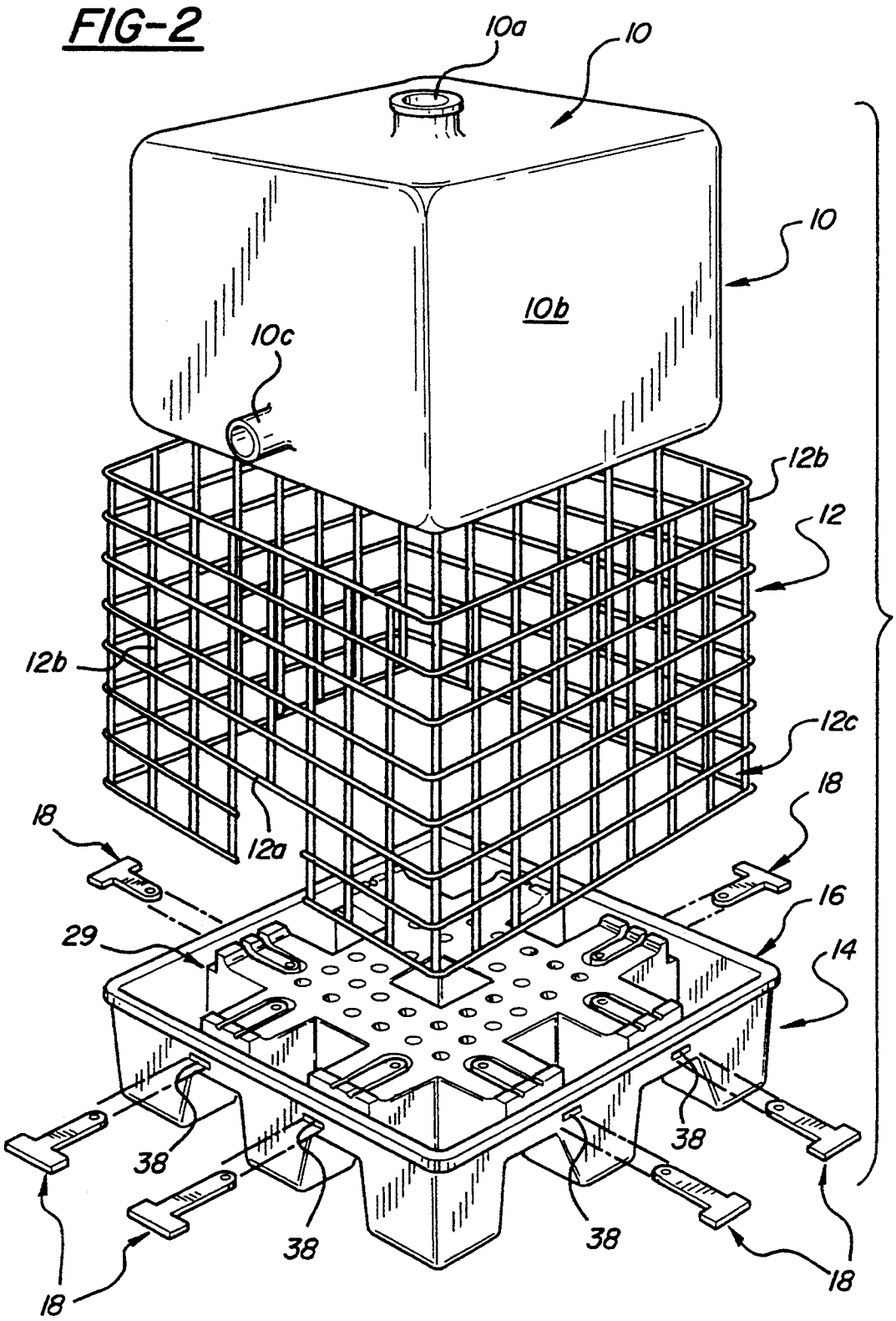
FIG. 2 is an exploded view of the container of FIG. 1 showing a bottle, sleeve, and pallet constituting the container.
Figure 3:
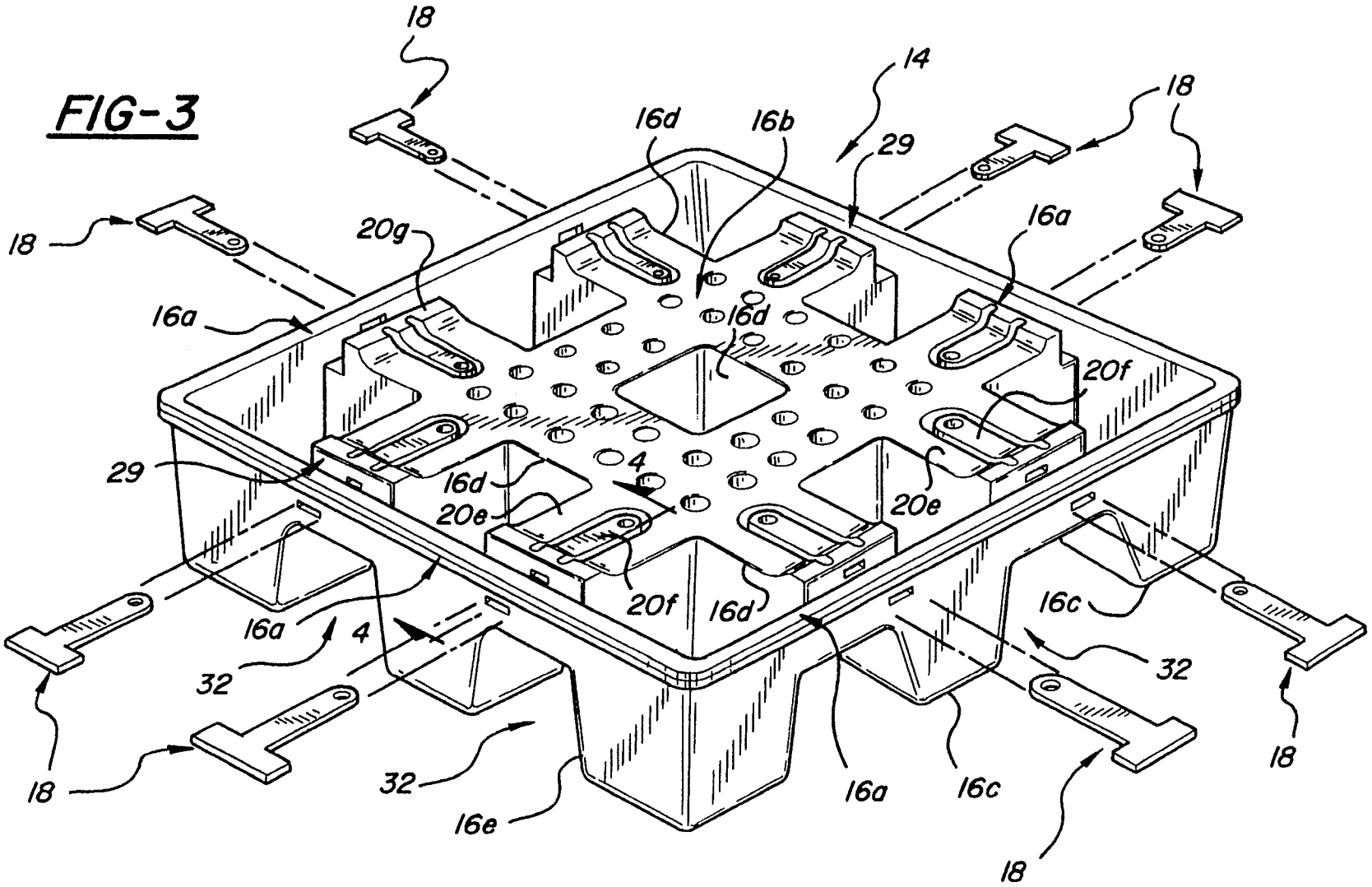
FIG. 3 is a perspective view of the pallet of the invention container
Figures 4, 8:
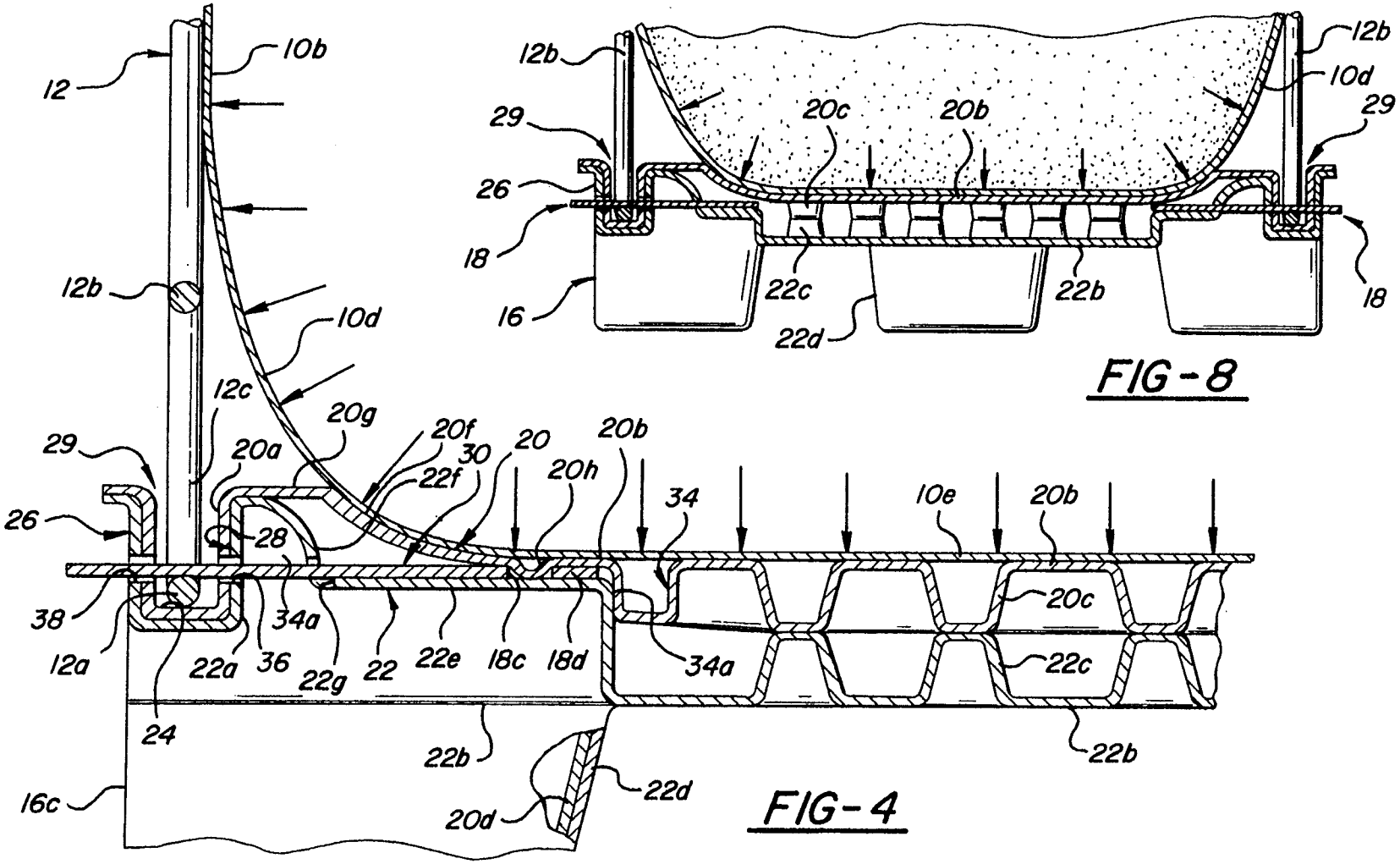
FIG. 4 is a cross-sectional view taken on line 4—4 of FIG. 3.
FIGS. 7 and 8 are somewhat schematic top and side views of the invention container.
Figures 5, 7:
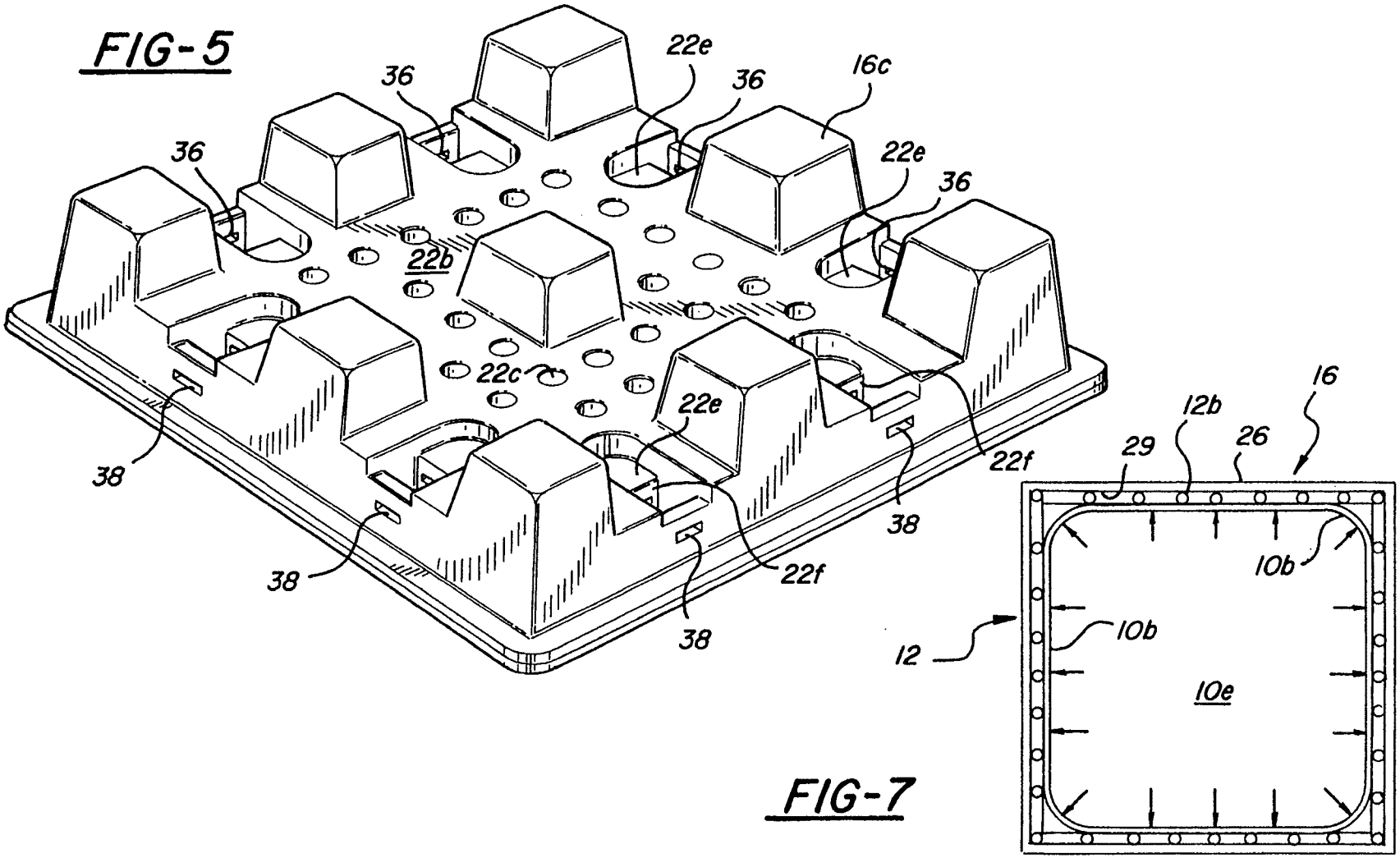
FIG. 5 is an inverted perspective view of the pallet of the invention container.

The invention bulk container, broadly considered, includes a bulk bottle 10, a sleeve or cage 12, and a pallet assembly 14.

Bottle 12 is of known construction and is preferably formed of a blow molded polyethylene. Bottle 10 has a generally cubicle configuration with rounded corners at all intersecting faces and includes a filler neck 10*a*, a sidewall structure 10*b*, and a drainage or a discharge structure 10*c*. The container may, in known manner, be provided according to one specification for handling non-hazardous liquids and in a further specification for handling hazardous liquids.

Sleeve or cage 12 has a generally rectangular configuration and is sized to nestingly receive bottle 10 with drainage structure 10*c* positioned in a cage cut-out 12*a*. Sleeve 12 is formed of stretched steel wires 12*b* which are assembled by welding.

Pallet assembly 14 includes a pallet 16 and strap members 18.

Pallet 16 embodies a twin sheet plastic construction including upper and lower sheets or skins 20 and 22 formed of an organic polymeric material such as polyethylene in a vacuum forming operation and selectively fused or knitted together at various points to form the pallet. In overview, the pallet 16 is rectangular and includes an outer peripheral portion 16*a*, a central platform portion 16*b*, and a plurality of legs 16*c*. It will be understood that upper and lower plastic sheets 20 and 22 are selectively configured in the vacuum molding operation so that they may be selectively fused together to form the various aspects of the pallet including the annular outer peripheral portion 16*a*, the central platform portion 16*b*, and the leg portions 16*c*.

Specifically, sheets 20, 22 include annular outer peripheral portions 20*a* and 22*a* which have a U-shaped configuration in cross section and which are fused together in nested configuration to form the annular outer peripheral portion 16*a* of the pallet. Nested and fused sheet portions 20*a* and 22*a* coact to define an annular seat 24 extending around the outer periphery of the pallet, an upstanding rim 26 extending around the pallet in surrounding relation to seat 24, and an upstanding inner wall structure 28 confronting rim 26 and coacting with rim 26 to define a groove or channel 29 for receipt of the lower edge portion 12*c* of the cage with the lower wire 12*d* of the cage positioned on annular seat 24.

Platform portion 16*b* of the pallet is formed by respective central portions 20*b* and 22*b* of the upper and lower sheets which are vertically spaced apart and include downstanding and upstanding bosses 20*c* and 22*c*, respectively, which are fused together at their interfaces to form columns extending between the upper and lower sheets and rigidly supporting the upper and lower sheets in their spaced configuration so as to form a rigid central platform portion.

Leg portions 16*c* are formed by downwardly extending fused together portions 20*d* and 22*d* of upper sheet 20 and lower sheet 22 and define openings 16*d* opening in the upper face of the pallet and forming interruptions in annular seat 24 as well as interruptions in platform portion 16*b*. The portions 20*e* of upper sheet 20 between respective leg openings 16*d* will be seen to have an upwardly bowed configuration so as to conform to the rounded lower corner configuration 10*d* of the bottle 10 so that the lower corner 10*d* of the bottle can be firmly supported on upper sheet portions 20*e* with the bottom 10*e* of the bottle supported on the central region of the pallet. The central platform portion 16*b* of the pallet will thus be seen to define a saddle structure to provide firm embracing support for the bottom of the bottle including the bottom corner portions of the bottle.

Upper and lower sheets 20 and 22 are further configured to define a plurality of slots on channels 30 at circumferentially spaced locations around the pallet. Each channel 30 extends generally perpendicular to a respective side edge of the pallet and is positioned between a pair of leg openings 16*d* in overlying relation to one of the tunnels 32 defined beneath the pallet between legs 16*c* and providing access for the forks of a forklift truck or similar material handling apparatus.

Each channel 30 is formed by an upwardly displaced portion 22*e* of lower sheet 22 and a bowed portion 20*f* of the upper sheet constituting a central section of a bowed portion 20*e* of the upper sheet. Each upper sheet portion 20*f* is joined at its outer extremity to a flat upper wall portion 20*g* which in turn is joined at its outer extremity to the channel portion 20*a* of the upper sheet, and each lower sheet portion 22*e* is joined at its outer extremity to an upwardly angled wall portion 22*f* which in turn is joined at its outer extremity to the channel portion 22*a* of the lower sheet. Upper sheet 20 is further downwardly configured to define a U-shaped groove 34 which is fused to the respective underlying upwardly displaced portion 22*e* of the lower sheet and includes a sidewall 34*a* which extends around and defines three sides of the perimeter of each slot 30. Each channel 30 is accessed by a slot 22*g* formed in the lower sheet at the juncture of sheet portion 22*e* and upwardly angled wall portion 22*f*, and each slot 22*g* is circumferentially aligned with a slot 36 formed in inner wall structure 28 and with a further slot 38 formed in rim 26.

Each strap member 18 is formed of a suitable plastic material, such for example as the same material utilized to form the upper and lower sheets 20 and 22 of the pallet, and includes a main body or latch portion 18*a* and an enlarged head portion 18*b*. Latch portion 18*a* is sized to fit slidably through slots 38, 36 and 22*g* so as to position the latch portion within a respective channel 30 and includes a hole or aperture 18*c* proximate the inner end of the strap member for locking coaction with a downward protuberance 20*h* formed in upper pallet portion 20*f* proximate the inner end of the channel 30 so that as the strap member is passed through aligned apertures 38,36 and 22*g* for entry into the channel 30, and as the latch member approaches the inner end of the channel, protuberance 20*h* yields upwardly to allow the passage of the extreme forward end 18*d* of the strap member and thereafter snaps downwardly to lockingly coact with the hole 18*c* to anchor the inner end of the strap member to the platform portion of the pallet. Latch portion 18*a* has a length such that, with the protuberance 20*f* lockingly engaging with the opening 18*c*, head portion 18*b* is positioned against the outer surface of rim 26.

In the use of the invention bulk container, the lower peripheral portion 12*b* of cage 12 is positioned in channel 30 with the lower wire 12*d* of the cage positioned on seat 24; each strap member 18 is passed through a respective slot 38, slot 36 and slot 22*g* for positioning within a respective channel 30 with the respective protuberance 20*h* lockingly coacting with the respective hole 18*c* in the inner end of the strap member, the head portion 18*b* of the strap member positioned against the outer surface of rim 26, and an intermediate portion of the strap member positioned within the channel 30 and overlying and effectively trapping the lower wire 12*d* of the cage so as to prevent inadvertent separation of the cage from the pallet; bulk bottle 10 is positioned in the cage with its sidewall structure 10*b* juxtaposed to the cage sidewall structure, its bottom 10*e* positioned on the platform portion of the pallet, and drainage structure 10*c* positioned within the cage cutout 12*a;* and the bottle is filled with a suitable liquid through the neck 10*a*.

With the bottle filled with a suitable liquid, the sidewall structure 10*b* of the bottle bulges outwardly so that the liquid in the bottle exerts a force outwardly via bottle sidewall structure 10*b* against the sidewall structure of the cage and simultaneously exerts a downward force against the platform portion of the pallet. The downward force exerted against the platform portion has the effect of further anchoring the inner end of each strap member 18 to the platform portion of the pallet and the outward force exerted against the sidewall structure of the cage is transferred via the cage to an outward force acting against pallet rim 26. The outward force acting on the rim 26 is in turn transferred to the strap members 18 via the strap member head portions 18*b* so that each strap member pulls outwardly on the platform portion of the pallet via its anchored inner end. The circumferentially spaced strap members thus exert a combination of outward pulling forces at locations spaced circumferentially around the platform portion of the pallet so as to tension the platform portion in the manner of a drum. This tensioning of the platform portion of the pallet has the effect of minimizing downward bulging and distortions of the platform portion of the pallet under the extremely heavy loading generated by the liquid in the bottle and, accordingly, has the effect of allowing a relatively lightweight plastic pallet to support an extremely heavy load, as constituted by the bottle and the liquid in the bottle, without undue bowing, bulging or distortion of the pallet platform portion.

The invention will be seen to provide an improved pallet construction, especially suitable for use as the support pallet for a liquid bulk container, which allows the use of a relatively lightweight plastic pallet to support an extremely heavy liquid load without undue bowing or distortion of the pallet.

Although a preferred embodiment of the invention has been illustrated and described in detail it will be apparent that various changes may be made in the disclosed embodiment without departing from the scope or spirit of the invention. For example, although the invention bulk container has been described as including a bulk liquid bottle for receipt of a bulk liquid, the invention is equally applicable to other bulk receptacles adapted to contain other fluid bulk materials, as well as to containers in which the sleeve is made imperforate, the bulk receptacle is omitted and the bulk fluid material is received directly within the sleeve.

We claim:

1. A container comprising:

a pallet defining an annular outer peripheral portion defining an upwardly facing annular seat and a central platform portion within the outer peripheral portion;

an annular sleeve including an annular sidewall structure and an annular lower edge portion positioned on said annular seat;

a bulk receptacle positioned on the pallet within the sleeve so that bulk fluid material positioned within the receptacle exerts a force outwardly against the sleeve sidewall structure and a downward force against the pallet platform portion; and a plurality of flat elongated strap members spaced circumferentially about the pallet, having outer ends passing through openings in the sleeve, and having inner ends positioned above a platform section of the central platform portion of the pallet and beneath the receptacle so as to be anchored between the receptacle and the platform section by the downward force exerted by bulk fluid material in the receptacle wherein the central platform portion of the pallet includes a plurality of circumferentially spaced channels extending inwardly from the outer peripheral portion of the pallet toward the center of the platform portion of the pallet and the inner end of each strap member is positioned beneath the bulk fluid material within the receptacle so that the downward force exerted by the material on the platform portion serves to anchor the inner end of the strap member in the respective channel.

2. A container according to claim 1 wherein said pallet includes an upstanding rim extending around said annular seat so as to surround the annular lower edge portion of the sleeve positioned on the seat and each strap member includes a head portion positioned outwardly of said upstanding rim.

3. A container according to claim 1 wherein the pallet is a twin sheet plastic structure including upper and lower sheets selectively spaced apart to define the plurality of circumferentially spaced inwardly extending channels for respective receipt of said strap members.

4. A container according to claim 1 wherein the bulk receptacle includes a sidewall structure juxtaposed to the sidewall structure of the sleeve so that bulk fluid material positioned within the receptacle exerts an outward force on the sleeve via the receptacle.

5. A container according to claim 4 wherein said receptacle is a bulk liquid bottle.

6. A container comprising:

a pallet defining an annular outer peripheral portion defining an upwardly facing annular seat and a central platform portion within the outer peripheral portion;

an annular sleeve including an annular sidewall structure and an annular lower edge portion positioned on said annular seat;

a bulk liquid receptacle positioned on the pallet within the sleeve so that bulk fluid material positioned within the receptacle exerts a force outwardly against the sleeve sidewall structure and a downward force against the pallet platform portion; and means operative to transfer the outward force on the sleeve into an outward force on the annular outer peripheral portion of the pallet so as to tension the platform portion in the manner of a drum;

said transfer means comprising an upstanding rib extending around said annular seat so as to surround the annular lower edge portion of the sleeve positioned on the seat and a plurality of circumferentially spaced strap members each having its inner end anchored to the pallet platform portion, passing outwardly through an opening in the annular lower edge portion of the sleeve, and including a head positioned outwardly of said upstanding rim;

the inner end of each strap member being positioned beneath the bulk fluid material within the sleeve so that the downward force exerted by the material on the platform portion serves to anchor the inner end of the strap member;

the pallet comprising a twin sheet plastic structure including upper and lower sheets selectively spaced apart to define a plurality of circumferentially spaced inwardly extending channels for respective receipt of said strap members;

the inner end of each strap member including a hole and one of said sheets defining a protuberance proximate the inner end of each channel for interlocking positioning within the hole in the inner end of the respective strap member to augment the anchoring of the strap member.

7. A container comprising:

a pallet defining an annular outer peripheral portion defining an upwardly facing annular seat and a central platform portion within the outer peripheral portion;

an annular sleeve including an annular sidewall structure and an annular lower edge portion positioned on said annular seat;

an upstanding rim extending around said annular seat so as to surround the annular lower edge portion of the sleeve positioned on the seat; and a plurality of circumferentially spaced strap members each having its inner end anchored to the pallet platform portion, passing outwardly through an opening in the annular lower edge portion of the sleeve, and including a head portion positioned outwardly of said upstanding rim;

each strap member also passing through an opening in said rim;

said container further including a bulk receptacle positioned within said sleeve on said platform portion and the inner end of each strap member being positioned beneath the receptacle so that the downward force exerted by bulk material in the receptacle on the platform portion serves to anchor the inner end of the strap member;

said pallet comprising a twin sheet plastic structure including upper and lower sheets selectively spaced apart to define a plurality of inwardly extending channels for respective receipt of said strap members;

the inner end of each strap member including a hole and one of said sheets defining a protuberance proximate the inner end of each channel for interlocking positioning within the hole in the inner end of the respective strap member to augment the anchoring of the strap member.

* * * * *